United States Patent [19]

Soubie

[11] 4,144,607

[45] Mar. 20, 1979

[54] BAG AND FLOTATION BUOY

[76] Inventor: Pierre J. Soubie, 8 & 10 rue Jules Colombain, La Londe les Maures, France

[21] Appl. No.: 786,331

[22] Filed: Apr. 11, 1977

[30] Foreign Application Priority Data

Apr. 14, 1976 [FR] France ..... 76 11781

[51] Int. Cl.[2] ..... B63C 9/08

[52] U.S. Cl. ..... 9/339; 9/314; 224/148

[58] Field of Search ..... 9/301, 311, 312, 313, 9/314, 328, 329, 336–339, 340, 341, 400; 224/5 W, 8 R, 26 H

[56] References Cited

U.S. PATENT DOCUMENTS

| | | | |
|---|---|---|---|
| 803,910 | 11/1905 | Ledermann | 9/339 |
| 1,864,648 | 6/1932 | Haines | 9/312 |
| 2,009,551 | 7/1935 | Huebner | 9/336 |
| 2,313,151 | 3/1943 | Johnson | 9/311 |
| 3,829,918 | 8/1974 | Stamberger | 9/314 |
| 4,000,534 | 1/1977 | Cerniway | 9/338 |

*Primary Examiner*—Trygve M. Blix
*Assistant Examiner*—D. W. Keen
*Attorney, Agent, or Firm*—William Anthony Drucker

[57] ABSTRACT

A device capable of serving separately or simultaneously as a bag and as a flotation buoy has a body of sheet material with an access opening and apparatus for blowing in air to expand the body. The access opening allows insertion of the hand and fore-arm, and may have a screwed stopper or other convenient closure. The access opening and the inflation apparatus are preferably on opposite walls of the body. Shoulder and waist straps may be provided.

1 Claim, 8 Drawing Figures

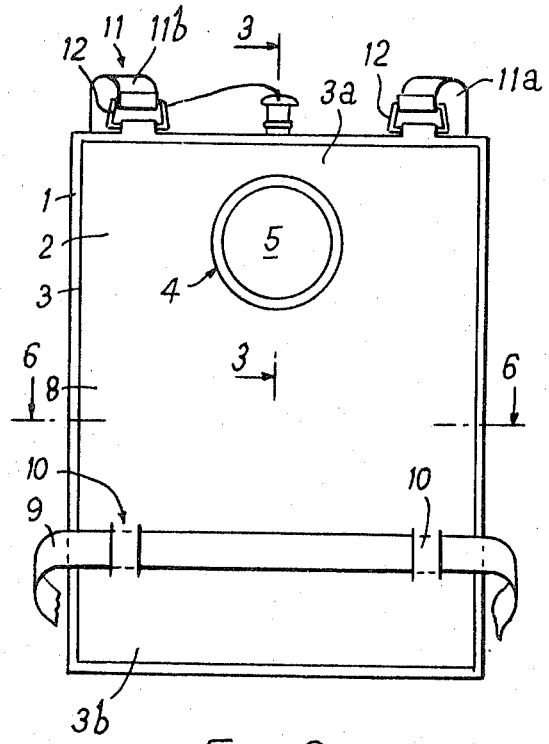
FIG. 1
FIG. 2
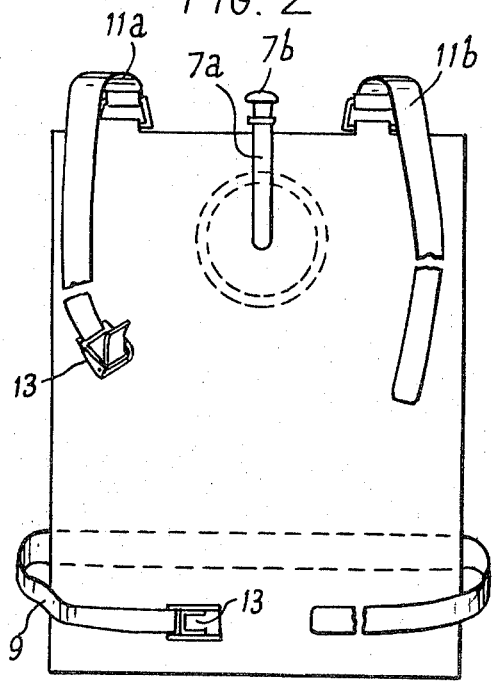
FIG. 3
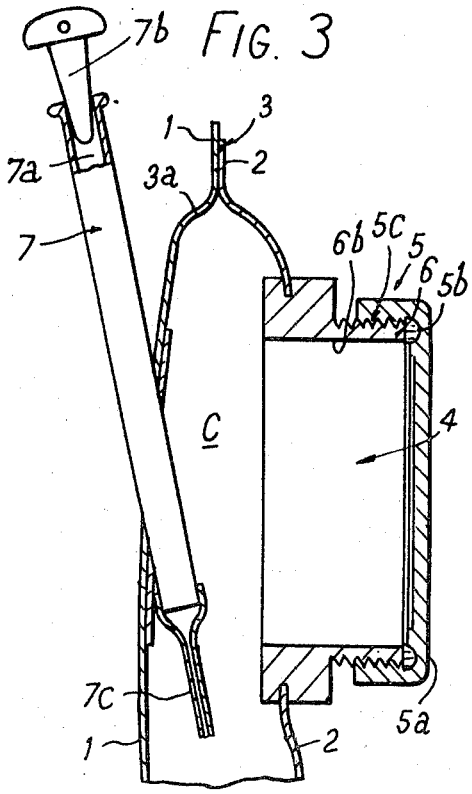

BAG AND FLOTATION BUOY

The present invention relates to an insubmersible combined bag and buoy, and particularly to a flexible watertight receptacle or container in which documents, clothing or provisions, which it is wished to keep dry, can be housed and which is capable of being inflated with air to float on the water and serve, in case of need, as a lifebuoy.

Such an insubmersible bag and buoy can be useful in a multiplicity of situations but it is of particular interest to pleasure or sports boating enthusiasts and notably the occupants of small craft which are at greater risk from wash, capsizing and shipwreck. It could be essential to sportsmen sailing on or exploring rivers and fast-running streams.

Floating bags comprising a pocket making it possible to house miscellaneous objects, the walls of which are provided with inflatable chambers giving the pocket buoyancy, are already known. However, these floating bags have proved to be of no real practical use because of the drawbacks arising out of their structure. If the floats are inflated before filling the bag, the inside volume of the latter is reduced by the inflation of said floats; while if the bag is filled first, its contents hinder the inflation of the floats. The result therefore is either a small-capacity bag, or inefficient floats. To increase this capacity and this efficiency, the dimensions of the device must be increased, which is not very compatible with handy use.

Further, the known floating bags are not really watertight, and their closing and inflation systems are not easy to use.

One object of the present invention therefore is to create an insubmersible bag and buoy of simple design providing a large capacity for stowing miscellaneous objects in a small volume and at the same time constituting an efficient lifebuoy.

Another object of the invention is to provide a perfectly watertight insubmersible bag and buoy, which is handy to use and is capable of being inflated quickly.

According to a first feature, the insubmersible bag and buoy in accordance with the present invention consists of a flexible watertight envelope bounding an inner chamber and provided with an opening for access fitted with a watertight closing device, and with buccal or other means of inflation, both communicating with the inner chamber of said envelope.

According to another feature, the buccal or other means of inflation is fitted with a non-return valve.

These objects and features, and others, will be apparent more clearly from the ensuing description and the accompanying drawings, wherein:

FIG. 1 is a front view of an embodiment of the bag and buoy according to the invention;

FIG. 2 is a rear elevation illustrating the opposite face of said bag and buoy;

FIG. 3 is a section of a detail, on a different scale, and in section taken along the line 3—3 in FIG. 1;

Figure 4:
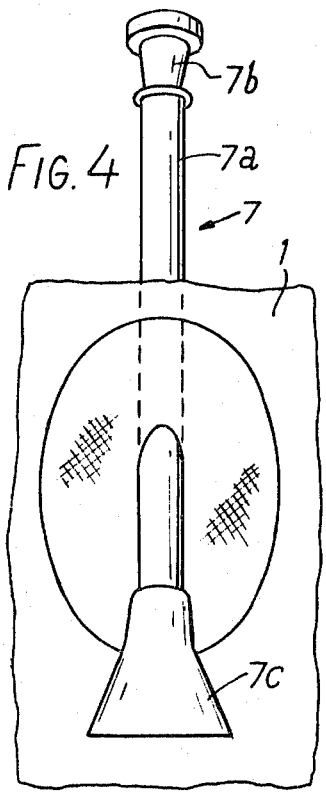
FIG. 4 is a detail view illustrating the buccal means of inflation.
Figure 5:
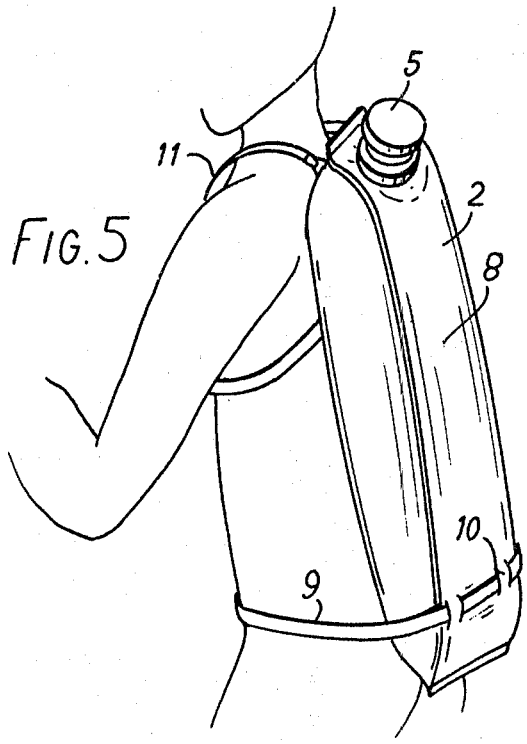
FIG. 5 shows the positioning of the bag and buoy on a user's back.

Reference is made to the drawings to describe the embodiments of the insubmersible bag and buoy according to the invention.

In its simplest form, illustrated in FIGS. 1 to 4 and 6, this bag and buoy consists of two flexible watertight sheets or panels 1–2, of the same dimensions and of rectangular or other shape, joined or assembled in watertight fashion along edge 3 by any known method of hot or cold glueing or welding so as to form a watertight envelope bounding an inner chamber C.

These flexible watertight panels can be made of any suitable material such as, for example, polyvinyl chloride (PVC) cloth, nitrile rubber, etc., or textiles coated with natural rubber or a synthetic elastomer such as polychloroprene ("Neoprene"), chlorosulphonated polyethylene ("Hypalon") or any other waterproof product.

One of these panels, preferably in the vicinity of one of its short sides which will be conventionally described by the term "top side" 3*a*, comprises an opening for access 4 fitted with a known watertight closing device and designated as a whole by the reference 5.

The size of the opening for access 4 allows at least the hand and forearm to pass easily through, and it may have a circular, quadrilateral or other shape.

In the example illustrated, the watertight closing device 5 consists of a cork or stopper 5*a* the bottom of which is fitted with a compressible annular gasket 5*b* and whose skirt or side wall has an internal thread 5*c*.

This stopper screws onto a rigid neck or body 6 fixed in watertight fashion on the edge of opening 4 and comprising an externally threaded flange 6*b* to receive said stopper.

It would also be possible to use other means of watertight closure, such as a stopper hinged on the edge of a rigid body fitted to opening 4 and provided with a known quick-fastening system acting by means of a pivoting or other lever, in the closed position.

The opening 4 for access is for the insertion into the watertight chamber C of the objects which it is desired to keep dry.

The watertight bag or receptacle so made is in addition fitted with buccal or other means of inflation, made in known manner and designated as a whole by the reference 7.

This means is arranged for example on the face of the bag opposite the one which is fitted with the access opening 4, preferably also in the vicinity of its top or top side 3*a*. This device advantageously consists of an inflation piece 7*a* fitted with a cork 7*b*, the inner end of which is made up of a double flexible membrane 7*c* forming a non-return valve preventing the exit of air or other liquid introduced into the watertight bag so made.

The outer face of the bag and buoy or the face which is visible when said bag and buoy is fitted on a person's back is preferably covered with a reflective surface 8, e.g. consisting of a film of suitably treated appropriate material and affixed by glueing or otherwise to said face. Moreover, the bag and buoy is fitted with straps enabling it to be fixed quickly and easily on a person's back. These straps advantageously include a belt 9 fitted so that it can slide in one or several keepers 10 integral with one of the faces of the bag and buoy and preferably positioned a short distance from its lower edge or bottom 3*b*, and also a shoulder strap 11 in two parts 11*a*–11*b* fixed by one end to rings 12 integral with the top side or top 3*a* of the bag and buoy. One of the ends of the belt 9 and one of the parts (part 11*a*) of the shoulder strap 11 is fitted with a buckle 13, e.g. of the lever type allowing adjustment and quick opening and closing.

The usefulness and advantages of the bag and buoy according to the present invention emerge clearly from the foregoing description and the accompanying drawings.

This bag enables any objects such as documents, clothes, provisions or other items to be kept dry irrespective of sailing conditions, even if the boat capsizes or is wrecked. Slightly or fully inflated, this bag is insubmersible and can be used as a lifebuoy.

The reflective surface 8 facilitates the spotting of the castaway by rescuers.

The watertight bag so made can also be used as a receptacle to store or transport drinking water or some other liquid.

Figure 7:
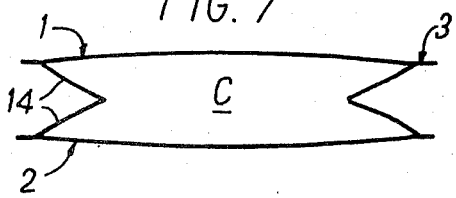
FIG. 7 is a sectional view, similar to FIG. 6, showing a variant of the bag and buoy.
Figure 6:
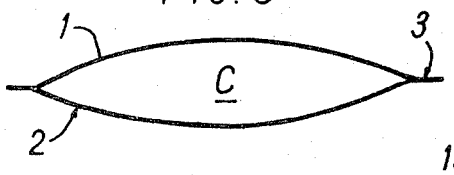
FIG. 6 is a section taken along the line 6—6 in FIG. 1.
Figure 8:
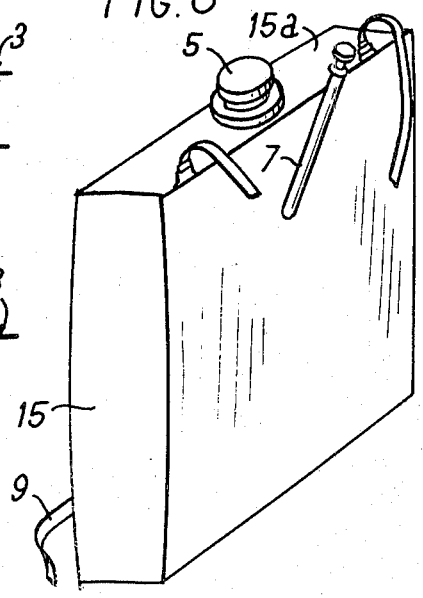
FIG. 8 illustrates, in a diagrammatic perspective view, another variant of the bag and buoy.

The capacity of the bag and buoy can be increased without enlarging the size of panels 1–2, e.g. by connecting the latter by a bellows 14 (FIG. 7) or by side strips 15 of greater or lesser width (FIG. 8) so that said bag, when inflated, is substantially parallelipipedal in shape. In the latter case, the access 4 and its watertight stopper 5 are preferably positioned on the short upper side 15*a* or top of the bag and buoy.

It will be understood that there is scope for making bags and buoys of different sizes and capacities, e.g. to fit children and adults of different build. Provision is also made for fitting the bag and buoy with handles for transport or to be used as holding or hanging points.

I claim:

1. An insubmersible bag and buoy including body attaching strap means comprising:

(i) a fluid-tight envelope made of flexible sheet material and including in its wall opposed first and second major wall portions, said wall portions being movable towards and away from each other for varying the volume of the envelope, said first wall portion having an opening therein of dimensions adequate to permit at least the hand and forearm to be inserted into the envelope, (ii) a rigid apertured body engaged in said opening of the first wall portion and sealed in fluid-tight manner to said wall portion, (iii) a rigid closure removably engaged on said apertured body to close the aperture thereof, and (iv) a conduit passed through said second major wall portion and defining an airflow path between the exterior and the interior of the envelope for inflation of the envelope, said conduit including a non-return valve arranged to permit fluid flow into the envelope and not out of the envelope.

* * * * *